US005483778A

United States Patent [19]

Scrivener

[11] Patent Number: 5,483,778

[45] Date of Patent: Jan. 16, 1996

[54] MODULAR PANEL SYSTEM HAVING A RELEASABLE TONGUE MEMBER

[76] Inventor: Paul Scrivener, Lot 48, Coulson Road, Monbulk, Victoria, 3973, Australia

[21] Appl. No.: 122,414

[22] PCT Filed: Apr. 3, 1992

[86] PCT No.: PCT/AU92/00145

§ 371 Date: Oct. 29, 1993

§ 102(e) Date: Oct. 29, 1993

[87] PCT Pub. No.: WO92/17662

PCT Pub. Date: Oct. 15, 1992

[30] Foreign Application Priority Data

Apr. 3, 1991 [AU] Australia ..... PK5371/91

[51] Int. Cl.[6] ..... E04B 2/18

[52] U.S. Cl. ..... 52/579; 52/580; 52/582.1; 52/586.1; 52/588.1; 52/591.1; 52/592.1

[58] Field of Search ..... 52/580, 588.1, 52/591.1, 592.1, 592.6, 821, 721, 579, 582.1, 586.1, 591.1, 588.1, 592.1

[56] References Cited

U.S. PATENT DOCUMENTS

| | | | |
|---|---|---|---|
| 3,236,014 | 2/1966 | Edgar . | |
| 3,608,258 | 9/1971 | Spratt | 52/591.1 |
| 3,683,576 | 8/1972 | Sikes | 52/580 |
| 4,165,591 | 8/1979 | Fitzgibbon . | |

FOREIGN PATENT DOCUMENTS

| | | |
|---|---|---|
| 0229041 | 7/1987 | European Pat. Off. . |
| 1002318 | 3/1952 | France . |
| 2632673 | 12/1989 | France . |
| 1559492 | 9/1969 | Germany . |
| 1759514 | 6/1971 | Germany . |
| 2259880 | 6/1974 | Germany . |
| 1161137 | 8/1969 | United Kingdom . |
| 2205597 | 12/1988 | United Kingdom . |

OTHER PUBLICATIONS

International Search Report, Intnational Application No. PCT/AU 92/00145, Australian Patent Office, 19 Jun. 1992.

*Primary Examiner*—Carl D. Friedman
*Assistant Examiner*—Christopher Todd Kent
*Attorney, Agent, or Firm*—Knobbe, Martens, Olson & Bear

[57] ABSTRACT

A modular construction panel comprising a rectangular frame of channel construction wherein three first channel elements and have the hollow facing exterior to the side of said panel and the remaining first channel element having the hollow facing the interior of the panel. The flush surface of is provided with a smaller dimensioned channel attached flush surface to flush surface so as to provide a male tongue adapted for engagement with the hollow of any of the remaining channels. The frame may have insulation provided internally and one or more skin claddings, attached to the outside.

22 Claims, 11 Drawing Sheets

FIG. 3a
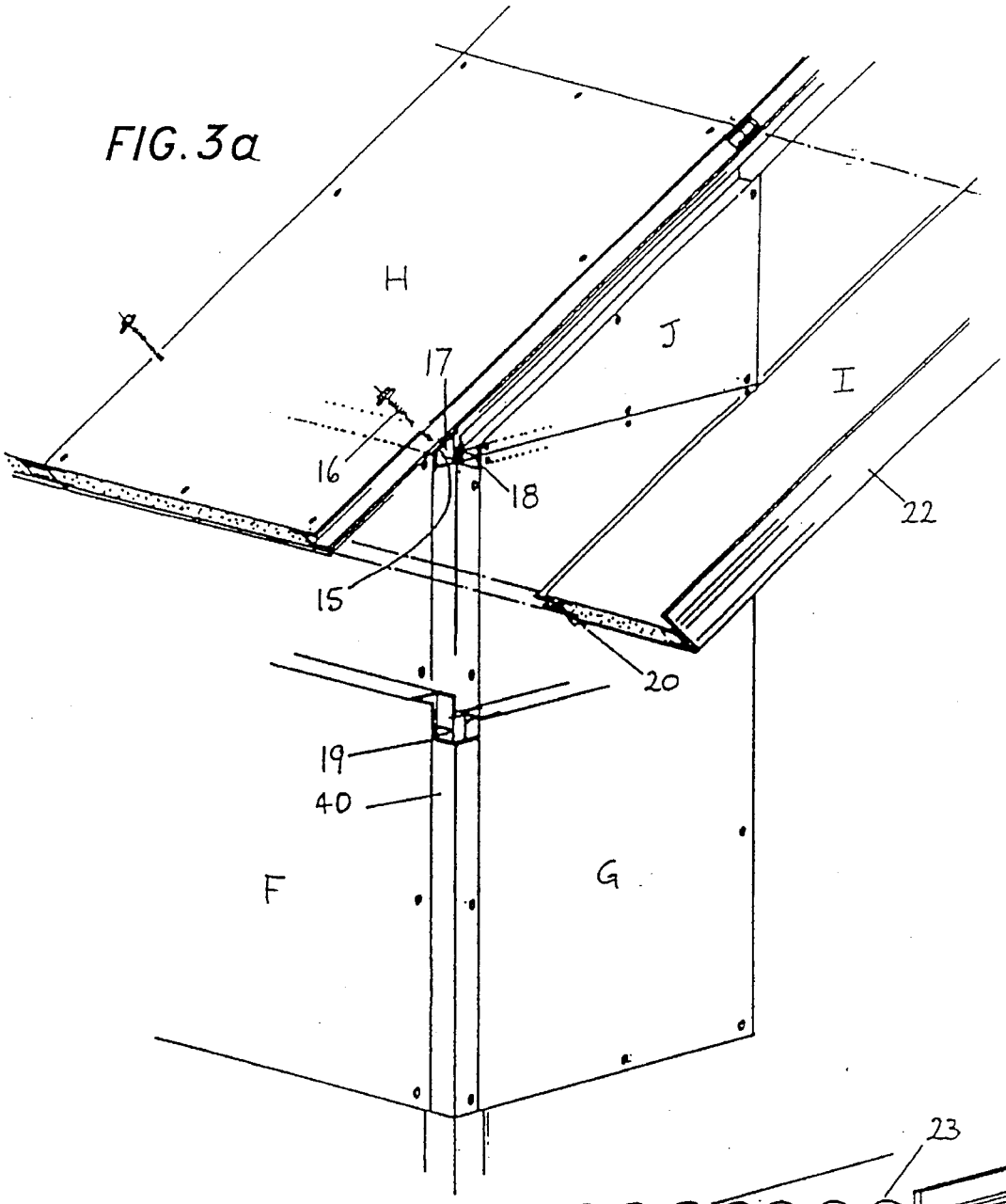
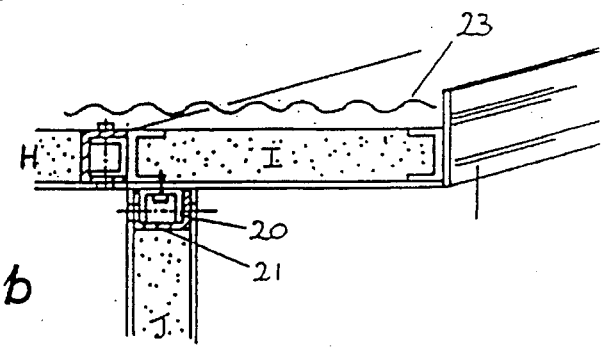
FIG. 3b

FIG. 4a
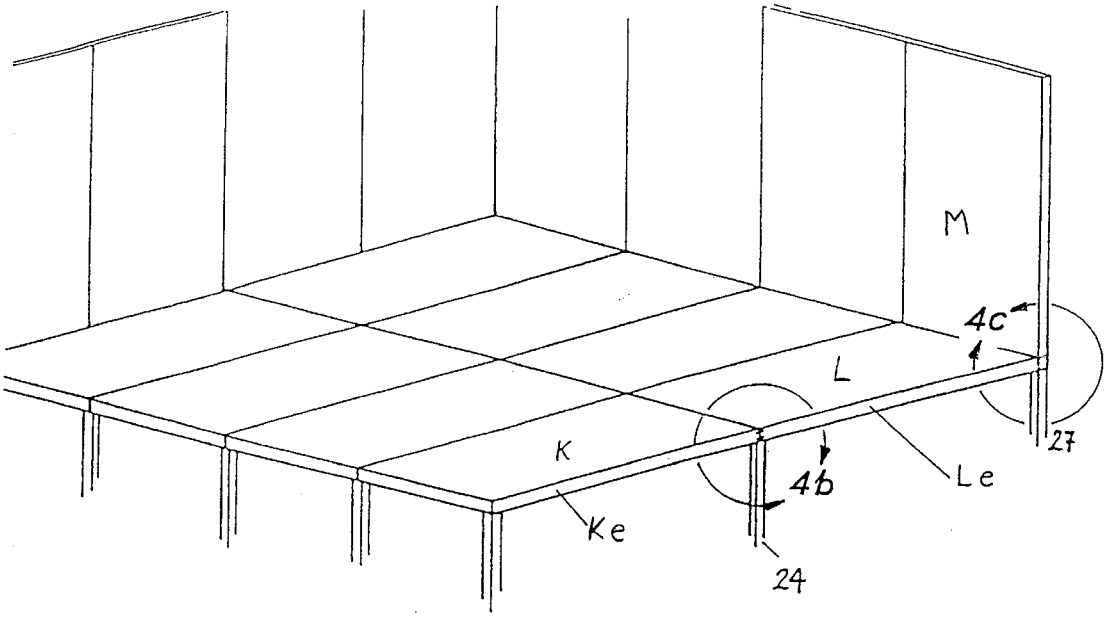
FIG. 4b
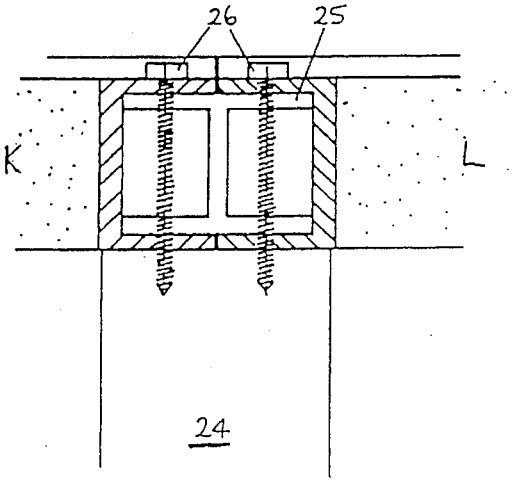
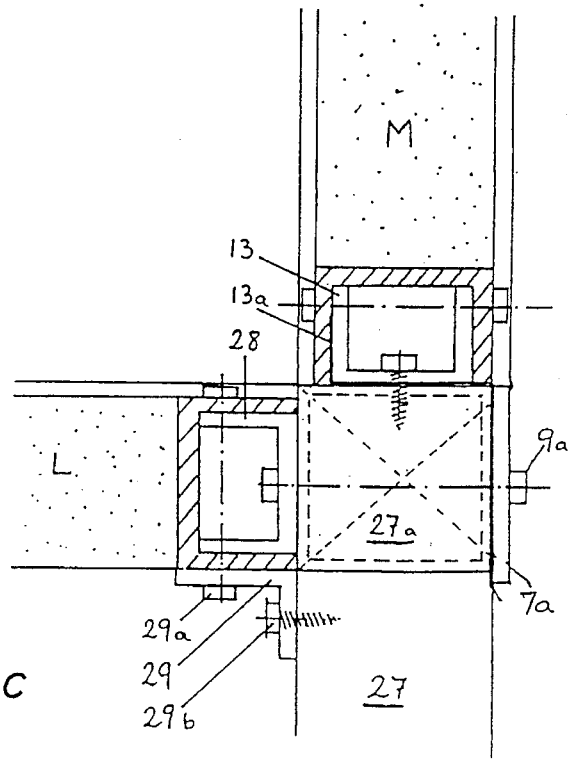
FIG. 4c

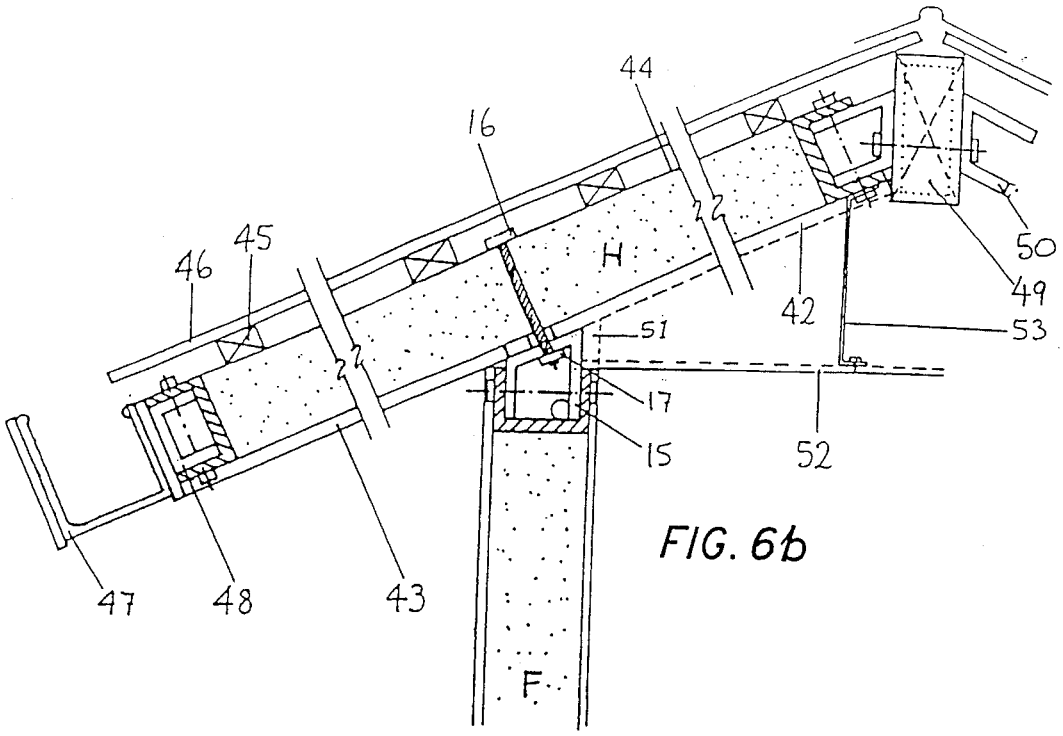
FIG. 6b
FIG. 6d
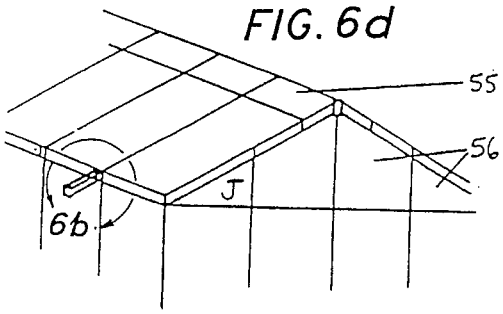
FIG. 6c
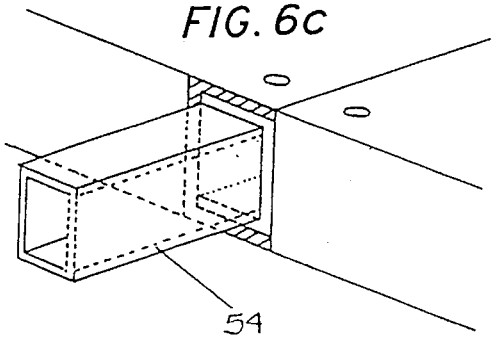
FIG. 6a
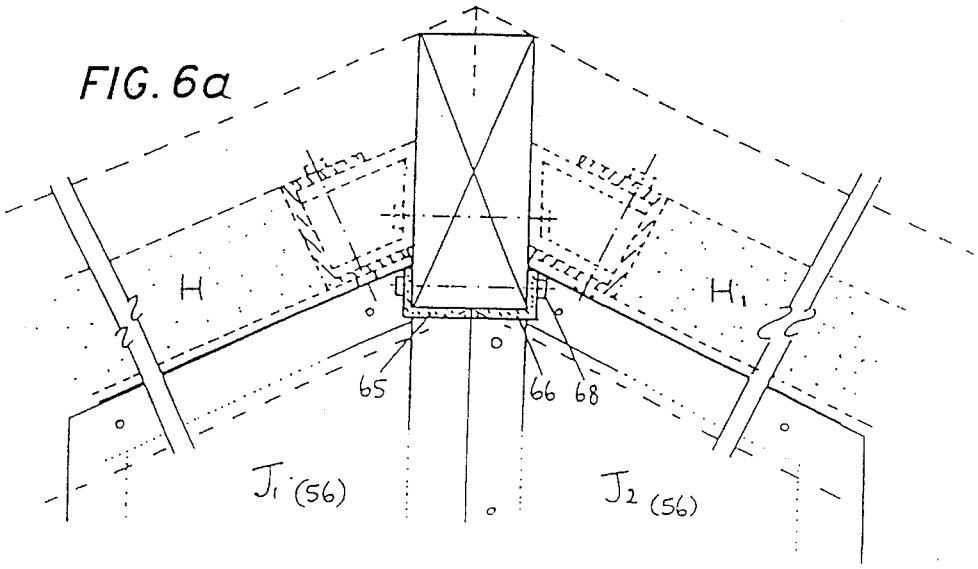

MODULAR PANEL SYSTEM HAVING A RELEASABLE TONGUE MEMBER

INTRODUCTION TO INVENTION

This invention relates to modular construction and components thereof and in particular to a universal modular unit and system of components for building construction.

BACKGROUND OF INVENTION

The concept of modular design has a long history with numerous areas of application in furniture, building, etc. Modularity in construction allows mass production of prefabricated units adapted for ready assembly into substantially complete constructions. Modularity has been applied very productively in the furniture industry where preformed modules can be assembled, on site, to manufacture a wide range of furniture. An equally applicable area for modularity is building construction, either in a domestic or an industrial scale and a plethora of such modules have been designed and applied very productively.

The principle of modularity can be applied in a variety of aspects, for example, wall panels adapted to fit together for cladding purposes, floor panels, windows, doors, etc. Commonly the level of modularity is limited to a fixed range of components. However, a further level of modularity may see the same modules capable of forming a variety of components, for example, internal walls as well as floors, roof and ceiling, etc.

Clearly, if a given modular unit can perform a greater number of functions it is potentially able to increase cost and labour savings, and a large amount of innovation and design has been exercised in the development of such modular units. A key problem with multifunctional units is a concomitant loss of versatility of the units as the range of application increases. So, for example, a modular unit designed for internal wall construction only can be quite well adapted for this principle, but the same unit designed for external walls as well will usually be less well adapted for either task.

To date a fully universal modular building unit has not been developed which is capable of application to virtually all aspects of a given construction whilst retaining a suitable level of versatility. For example, the construction units disclosed in Australian Patent Applications 73336/81, 50573/79, 54804/86 and 23609/88 all display modular application but are limited to wall or partition application. Furthermore, units like AU50573/79 incorporate a highly specific asymmetric construction. AU73336/81 utilizes a complex connecting means and has an internal construction of limited strength and therefore limited application to a substantially vertical orientation. AU23609/88 discloses a more versatile system, however the construction suffers from limited torsional and horizontal strength and hence is limited to substantially vertical application.

More versatile units are described in Australian Patent Applications 77187/87 and 20952/88 and U.S. Pat. No. 3,236,014. All these disclosures detail panels suitable for modular building application albeit with limitations to universal application.

In particular, AU 77187/87 discloses a panel incorporating a laminate of core material with a skin material where the skin material has an integral connecting means moulded into the edge thereof. Such an inter-connecting method is clearly an advantageous development and capable of producing a strong and integral panel unit. However, such a design has limitations in the type of skin used in the laminate where only formable material can be used. Furthermore, the connecting method is fixed and incapable of modification.

Similarly, the disclosure in AU 20952/88 details a panel having a limited type of skin application coupled with a fixed type of connecting means incapable of modification.

U.S. Pat. No. 3,236,014 discloses a more highly versatile panel assembly Joint utilizing tongue and groove connecting means formed into a channel member, a core material and a laminated skin. Such a system offers the advantages of simple, strong connection between panels, a choice of core materials and a choice of skin materials. However, this disclosure fails to provide a fully universal modular unit capable of application to floors, walls and roof utilizing a simple system of connecting adaptors. The disclosure suffers from lack of modularity at the comer joint of walls and furthermore does not teach the use of one universal panel for floors, walls and roof.

OBJECT AND STATEMENT OF INVENTION

The object of the instant invention is to provide a substantially universal modular construction unit capable of adaptation to at least internal and external walls, floors, roof and ceilings.

Accordingly, the invention provides a modular construction panel comprising a rectangular frame of first channel construction wherein three channel elements of said frame have the channel hollow facing exterior to the side of said panel and the remaining first channel element having the hollow face thereof facing the interior of said panel and the flush face thereof provided with a tongue element attached thereto in longitudinal orientation, and having a dimension adapted to engage the hollow face of the said first channel elements wherein said rectangular frame is adapted for interconnection along each edge with an edge of a similar rectangular frame by a tongue and groove arrangement where the three first channel elements provide a groove for engagement with said tongue element.

Preferably the tongue element is a second channel element.

The rectangular frame may preferably have a length dimension being a whole multiple of the width dimension.

The rectangular frame may be provided with bracing in the form of a skin attached to the sides of at least two of the first channel elements.

The bracing may be in the form of a full skin attached to one or both sides of said frame or may be a partial skin.

Preferably the nesting engagement of the first and second channel elements provides a hollow therein common to a plurality of interconnected panels.

Preferably the second channel element is removably attached to the first channel element by bolting into captured nuts.

The frame is preferably constructed of metal where the channel elements are welded to form an integral rigid unit but may also be constructed of any other suitably rigid material, for example, carbon fibre, fibreglass, plastic, wood, etc.

The dimensions of the frame preferably provide a ratio of 2:1 for length to width but may also provide other whole ratios, for example, 3:1, 4:1, etc.

The skin cladding may be applied by adhesion or mechanical fastening and the internal space may be filled with thermal or acoustic insulation material.

As can be seen from the foregoing, the instant invention provides for the first time a fully universal modular unit capable of adaptation to all the panels needed in a building construction including walls, floors, roof, etc. The interconnection of the units shall be described in detail in the following preferred embodiment which fully details the connecting elements needed. Upon assembly of such units the full strength of the system is realized with virtually the whole building becoming interlocked. The instant invention therefore provides a method of construction where a whole building can be constructed of essentially two principle components being the frame channel section of the invention and the cladding. Such construction ensures minimum cost but does not sacrifice versatility as the cladding can be chosen from a broad range of materials available in the marketplace.

Referring briefly to the figures.

FIG. 2(*b–d*) detail jointing.

FIG. 3(*a–b*) shows a partially exploded and sectional view of a typical corner and roof assembly.

Figure 4D:
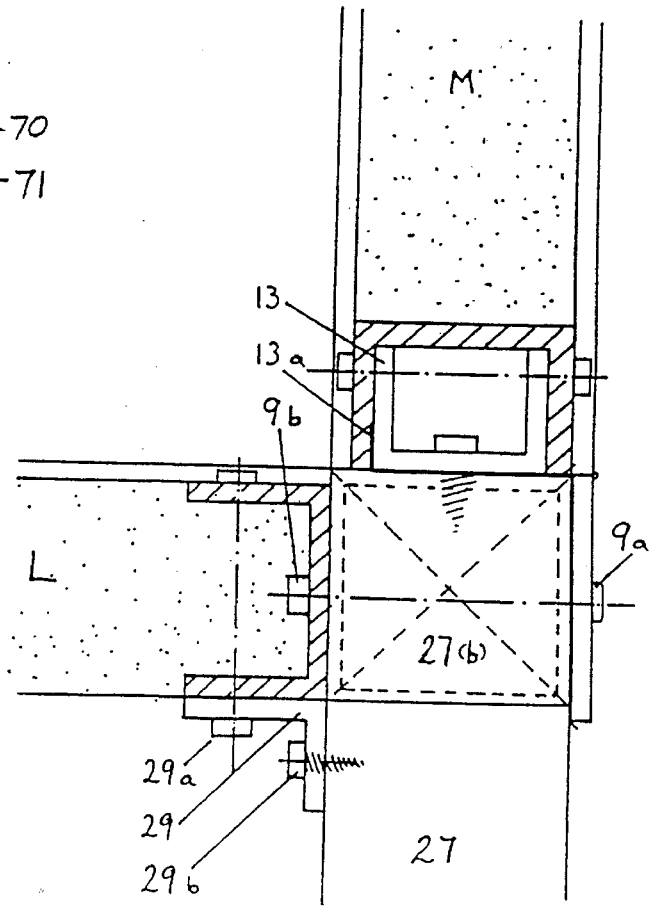

FIG. 4(*a–d*) shows a complete and cross-sectional view of a typical floor assembly.

FIG. 5(*a–d*) shows detail of various jointing possibilities between wall, roof and floor panel applications:

(*a*) external unit joint and internal wall junction (plan view);

(*b*) external or internal corner junction (plan view);

(*c*) internal wall joining roof to floor (elevational view);

(*d*) modified panel for use in 'closed module' situations.

FIG. 6(*a–d*) shows detail of jointing in roof applications:

(*a*) details of the fixing of the ridge beam to the end panels of a structure;

(*b*) roof to external wall connection cross-section with gutter and ridge details;

(*c*) detail of location of rigid section sleeve;

(*d*) overall roof and wall system complete with inserted square section sleeve for added strength.

FIG. 7(*a–c*) shows the provision techniques for doors and windows,

FIG. 8(*a–c*) shows an overview of a small room using standard sized panels and two reducer panels (smaller sized) to produce the required 'panel fit' into the modular system, The insets 8(*b*) and 8(*c*) show the layout of the 3 and 4-way junctions of these panels.

FIG. 9(*a–b*) shows an overview of an 'L" shaped design with a valley adjoining the two roof lines. The triangular shaped panels thus created are indicated by 'x'. The insert 9(*b*) shows cross-section 'a—a' with the bendable valley joiner piece.

DETAILED DESCRIPTION OF INVENTION

The invention will now be described in greater detail with reference to a particular preferred embodiment as detailed in FIGS. 1 to 9.

Figure 1:
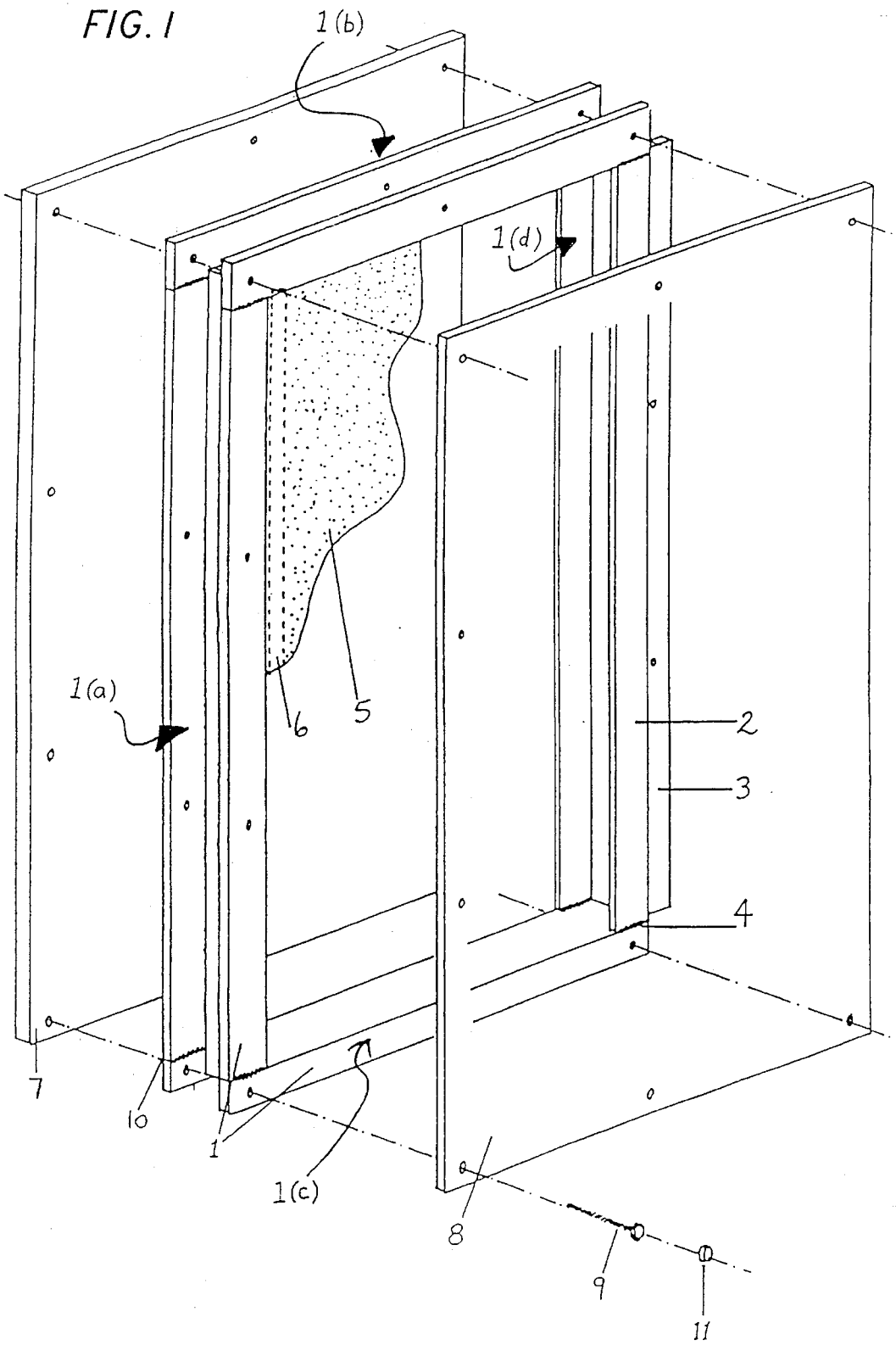
FIG. 1 shows a exploded perspective view of one panel unit.

Referring firstly to FIG. 1, the modular construction panel can be seen to comprise a rectangular frame (1) built up from a plurality of first channel elements 1(*a*), 1(*b*), 1(*c*) and 1(*d*), each element being formed of the same section material. Three sides of the frame 1(*a*), 1(*b*) and 1(*c*) are joined with the hollow of the channel pointing to the outside of the panel. The remaining side of the frame 1(*d*) is joined to face the hollow of the channel to the inside of the panel unit. The joining of the channel elements is by any suitable means depending on the type of material used for the frame. Where steel or aluminium is used, welding or rivetting would be suitable joining techniques. The channel element 1(*d*) is provided with a connecting means in the form of a second channel element (3) bolted to the first channel element 1(*d*) so as to provide a suitably dimensioned male connecting means adapted to fit into the inside of a corresponding panel channel element, for example 1(*a*). The connecting means (3) may be either a square section channel or a conventional channel having a ⊔ section.

In the particularly preferred form the channel elements are constructed of a malleable metal, for example aluminium, where the male and female connection of the channel elements is very snug and the abutting faces thereof are provided with a series of longitudinal grooves such that the channel elements may be press fitted together using the malleable plasticity of the material to effect adherance. The frame may also be made of steel, welded or rivetted together.

The frame construct thus forms a substantially rigid unit into which may be positioned a suitable core material (5). The core material may have insulating properties for heat, sound, etc. and any other desirable properties. The core material may be solid, particulate or provided with channels (6) for the provision of additional services. The frame construct however provides a specific hollow between the nesting channel elements to provide a substantially continuous hollow communication between adjoining panels such that services like plumbing, electricity, etc., may be conduited through.

The insulating core (5) may be constructed of polyurethane, polystyrene, rigid fibreglass, cellular plastics, etc.

The frame construct may then be clad with a skin material (7, 8) which may take any form suitable to the intended application. Some examples of these sheets are fibreboard, cement sheet, timber panelling, weather boards (both wood and vinyl), hardiplank, cement render, wafer brick or stone veneers, fibreglass sheet, corrugated iron, ceramic tiles. Wall boards of all types can be used (plasterboard, gyprock, compressed wood boards, recycled paper wall board), carpet, laminex, Formica, etc., particleboards, plywoods, all flooring materials. Any other cladding material appropriately used, can be used as part of this invention.

Referring now to FIG. 2.

It can be seen that panels A and B as described in FIG. 1 are shown from a cross sectional view. According to this invention they are interlocking along edges (12), and secured by threaded securing devices (9).

It can be seen that panel A is shown above the 'Perimeter Base Plate' (13). This is located onto the Perimeter Bearer 27(*a*) as seen in FIG. 4 (stump subfloor construction only) and pieces (13) and (13*a*) are located and fastened using any appropriate means (bolting, riveting, welding, screwing etc.). This example shows the Base Plate designed for standard floors, where location is made onto a bearer of floor panels made from the modular unit (panels) described in FIG. 1 (see FIG. 4 for further details). The holes in panel A and the plate (13) line up to accept the securing devices (9).

13(*a*) is a weather proofing strip flashing located between 13 and 27(*a*). Panel B can be seen in another situation where the panel is lowered onto the composite top, floor and bottom plate (14), designed to locate the lower storey wall with the top storey wall and the floor panels that make up the floor and ceiling of their respective floors. This is together (welded, bolted etc.) or the entire shape extruded to its described design (14). Again the holes line up in both the panel and the plate to facilitate accurate securing with devices (9).

Composite plate (14) would first be located onto panel C below then the floor/ceiling panel (not shown) and then second storey wall panel B.

Once the panels are secured together the top plate member (15) made of a suitable rigid material and approximately angled cross section (to suit the roof pitch), either bent or extruded to the designed shape, locates into the top of the frames of panels A and B. These are secured by the appropriate devices (9).

Panel D being appropriately clad for a roofing panel is then located over the fastening holes in (15). Long threaded securing devices (16) then lock the roof panel D onto the top plate member (15). The appropriate 'rivnut' (or similar) (17) is permanently attached to the underside of the top edge of (15) to accept securing device (16).

Roof panel E then locates into roof panel D as per the description in FIG. 2 and is secured, and so forth to form the entire roof structure. See FIG. 6.

Figure 2A:
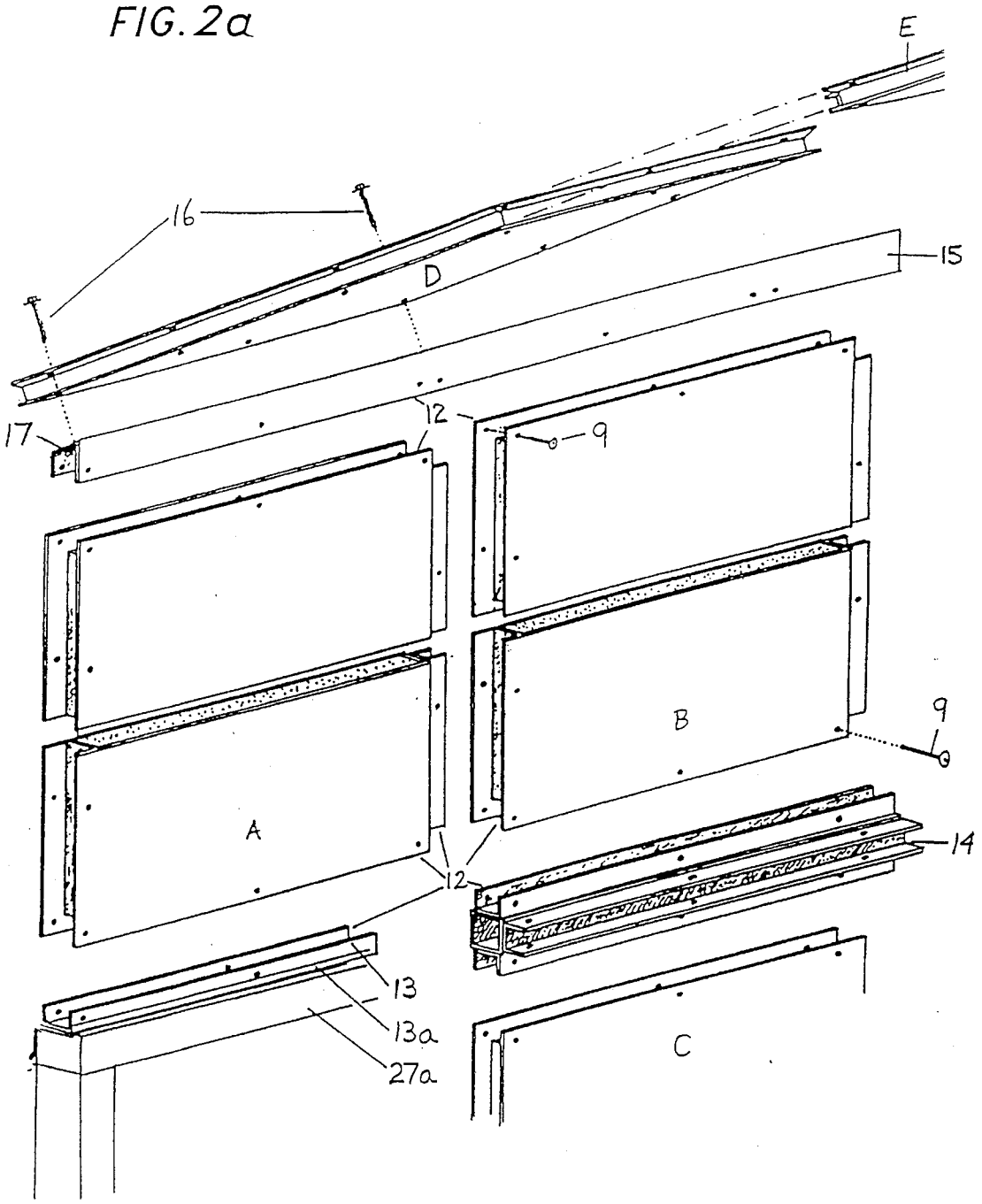
FIG. 2(*a*) shows an exploded view of wall and ceiling (roof) panels and the interconnecting plates as applied to single storey (a) and double storey (b).
Figure 2B:
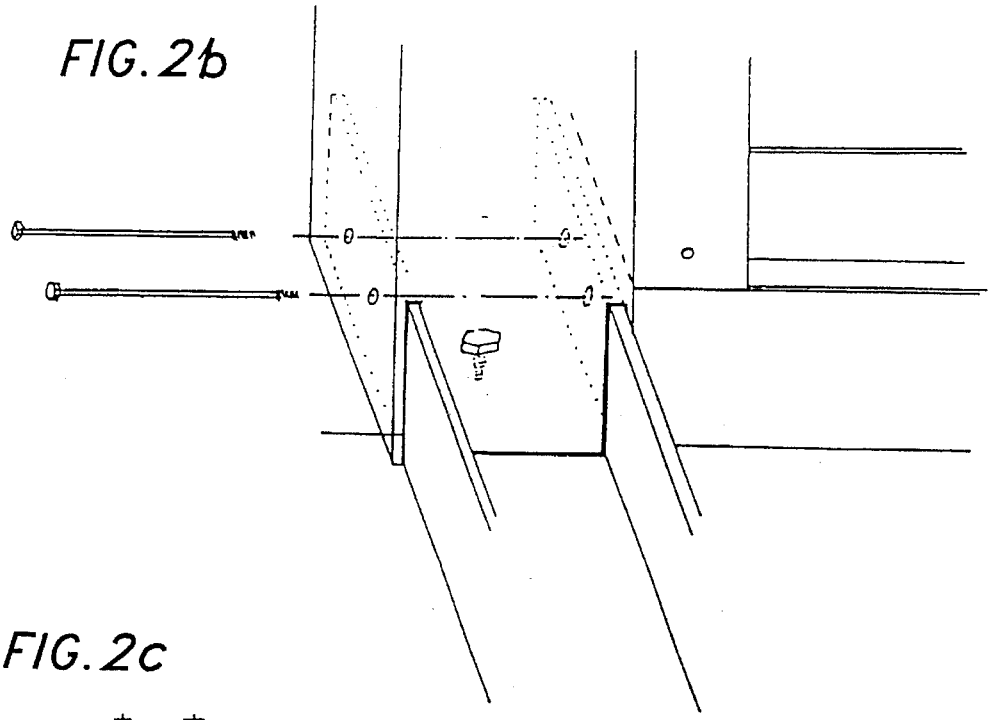
Figure 2C:
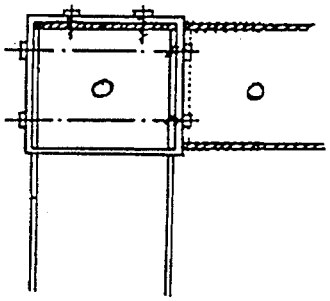
Figure 2D:
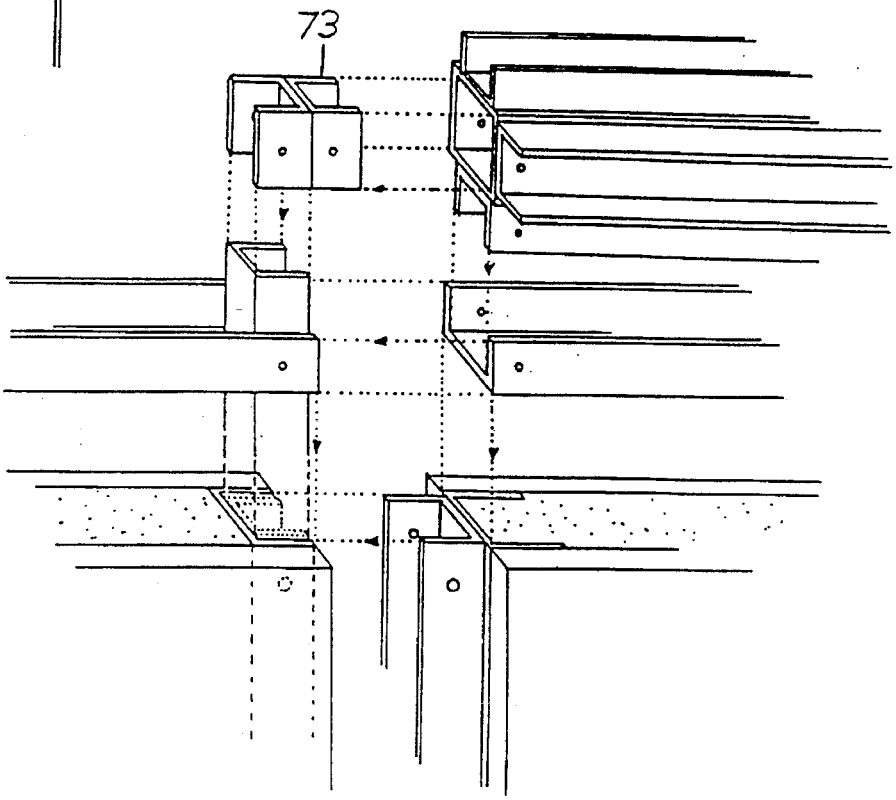
Figure 5D:
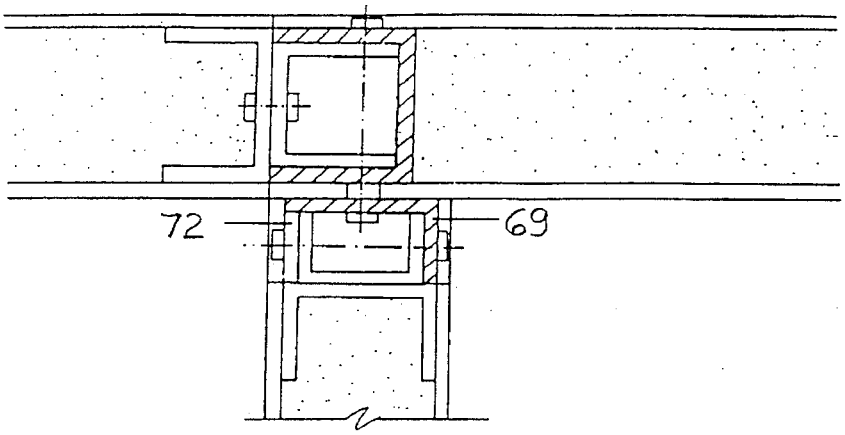
Figure 5D:
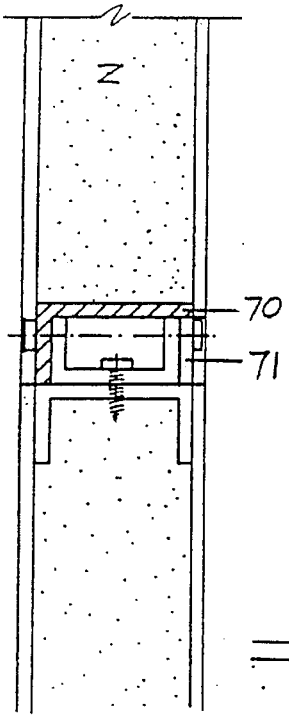

FIGS. 2*b–d* show details of the connecting means between panels where 2*b,c* provides housing for a corner post into two adjacent bottom or top plates. FIG. 2*d* details the connecting means for a multi-storey construction.

Referring now to FIG. 3

FIG. 3(*a*) shows the appearance of an external wall corner with cut away section to detail the interconnection of panels F and G with the comer joiner cladding piece (40). This is further detailed in FIG. 5*b*.

FIG. 3(*a*) also shows the assembled appearance of the roof panel H onto the wall panel F using top plate (15) and threaded fasteners (16) and nuts etc. as per FIG. 2. Also see FIG. 6(*b*).

FIG. 3(*b*) shows Panel H in cross-sectional view as it's lower end. Panel I or the eave panel attaches to panel H in the standard way and slides into triangular panel J using the ⊔ channel system (20) and (21) attached to the underside of panel I (as described in inset 3*a*). The fascia board (22) is attached to the outer edge of I. 'I' can be any width required for the Eave. Panels H and J are located and fastened on their opposite edges and then panel I with ⊔ channel piece (20) attached slides into the upper edge (21) of panel J until the fastening holes line up and then it is secured.

Once the panels are in place battens appropriate to the standard roof cladding (23) required can be attached. This can also be done at the factory with the roof cladding attached in such a way as to leave the appropriate cladding overlap attainable.

Referring now to FIG. 4

FIG. 4(*a*) shows a representational view of the assembled floor and two walls of a possible structure indicating how the modular panels locate together.

The panels can be any appropriate size to suit the needs of the structure.

FIG. 4(*b*) is the inset showing the joining technique of floor panel K to the floor panel L located over a standard stump (of suitable material) (24). The 'I', Channel or square section is of suitable rigid material drilled to align with the panel edge holes and stumps (24). This is inserted into the gap created by the panels abutting each other on the sides where the standard joining method is not available ie. on the shorter edges of the panels.

The floor panels are attached to the stump (24) using coach (26) screws or similar in the case of wooden stumps or metal threads embedded into the concrete in the case of concrete stumps. (These are then fastened from the top of the floor panel with nuts or similar.)

FIG. 4(*c*) shows the construction details of the external wall and internal floor junction located over external stump (27).

On top of the stump (27) lies the Bearer (27*a*) and flashing, (13*a*), (FIG. 2). These run around the entire perimeter of the structure. On top of this the ⊔ channel section (Base Plate) (13) (FIG. 2), is attached (using coach screws or similar) through the Flashing, into the top of the bearer. This also runs the perimeter of the structure. Panel M locates over this in the standard way (FIG. 2). Accordingly the Base Plate (13) must be laid straight and square. 27(*a*) can be made of any rigid material (ie. metal or wood etc.)

The floor panel L locates into another ⊔ channel section the same as (13) and (28). This is bolted or attached appropriately through the bearer, the flashing and the external cladding strip (7*a*) on the opposite side of the stump. The panel L attaches to this in the standard way. The floor panel L can be supported if required by an 'L' shaped bracket (29) of suitable rigid materials connected to panel L with the through bolt at (29*a*) and a coach bolt or similar at (29*b*). This bracket can run the entire perimeter of the structure.

FIG. 4(*d*) shows the securing method on the edges 'Le' and 'Ke' where there is no male/female channel connection. The angle support (29) must be placed along the full edge of the building, the panels K and L then locate in the usual manner. Then the final bearer (27*b*) is placed on stumps 27 and fastener 9(*a*) through the bearer and the moisture barrier (13*a*) as per 4(*d*) to locate and secure to the inside of the frame of panels L and K.

Securing Device 9(*a*) (longer than 9) locates into captured nut ('Rivnut' or similar) 9(*b*). This is built into the frame on assembly or on site as required.

With a concrete floor all the floor section of the invention is unnecessary and the invention starts with the flashing 13 (*a*) and the base plate (13) attached with dynabolts or similar.

Referring now to FIG. 5

Figure 5A:
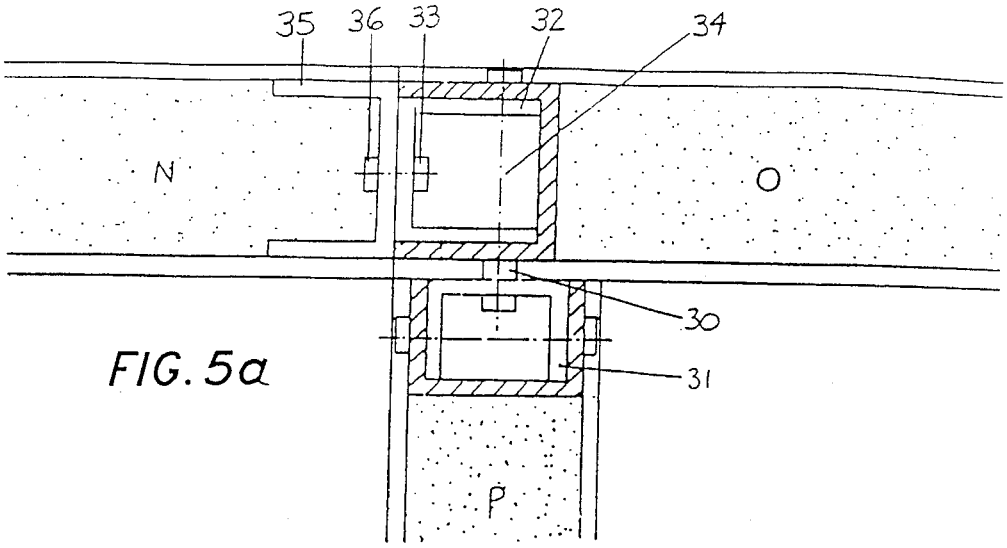

FIG. 5*a* shows the connecting method of internal walls to external panel joints as a cross-section of a plan view. Panels N and O connect in the standard way (as described in FIG. 2). The securing device (bolt or similar) (34), needs to be longer than the standard device as a rigid sleeve (30) will be placed in the interior bolt recess and a standard ⊔ channel section (31) is then placed to align with the holes in panel O and the extended fastener placed through the entire joint.

Interior panel P is a standard panel with interior cladding on both sides. This connects to (31) in the standard way.

The connection on the opposite interior wall would involve (if we used panel N as an example) the removal of ⊔ channel (32) by removing securing device (33). The remaining frame section (35) would then be secured to the external panel joint with a securing device threading from the external side through the joint into the permanent securing nut (36) on the inside of (35). This can be placed on site when and where required.

Figure 5B:
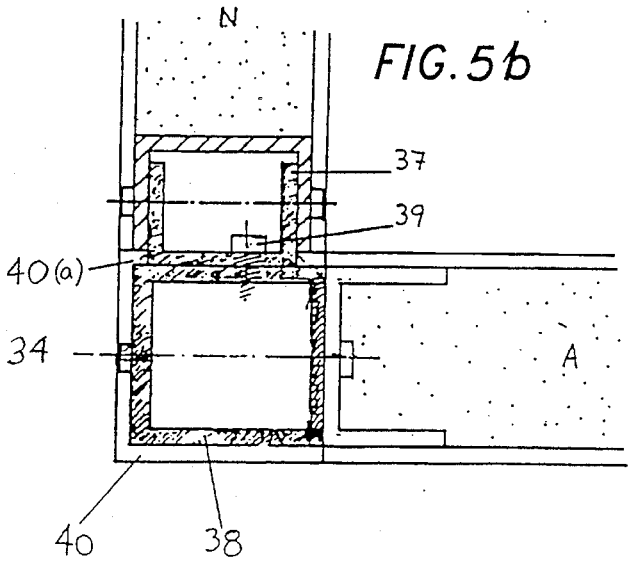

Referring now to FIG. 5*b*

This shows a cross-section of the Plan View of a typical corner.

The other end of panel N (for example) attaches to a two part structural corner piece; again of appropriate sized ⊔ channel pieces (37) and (38). (37) is attached first with a permanent nut style device (39) located to align with the predrilled holes in the male end of panel A. Section (38) then lines up with this and panel A slides into place. A securing device similar to (34) aligns and locates all the pieces and fastens into (39).

Around this corner piece a 'cap' of suitable external cladding material is clipped (40) using point (40*a*) as both clip and locator. Construction of the next wall then continues in the direction of A.

Figure 5C:
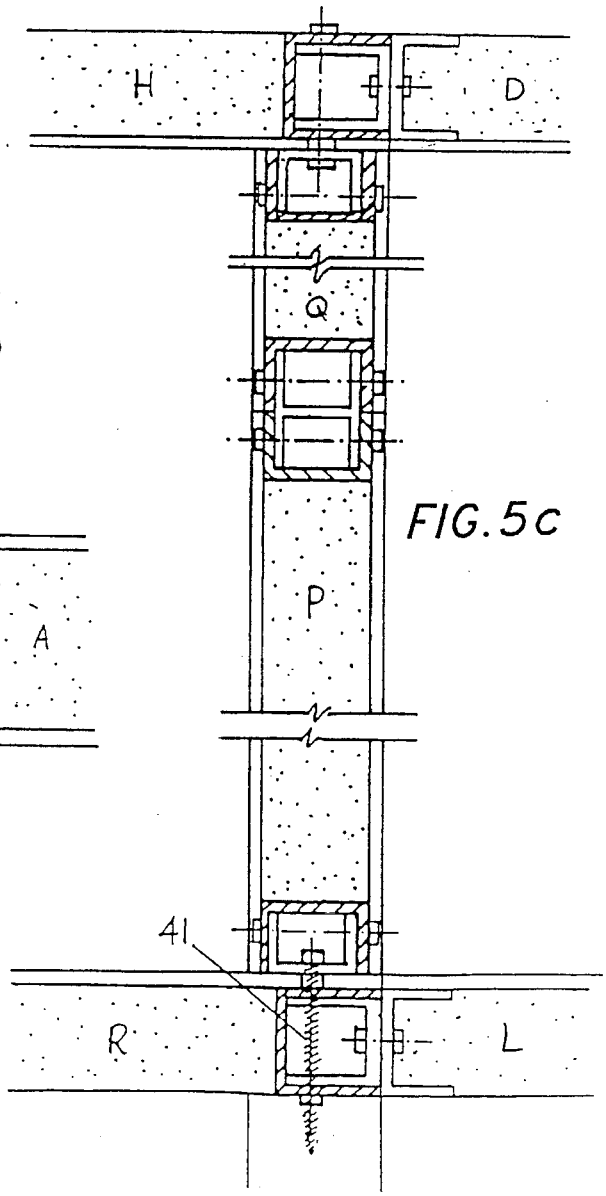

FIG. 5*c* shows a cross-sectional view through the roof, an internal wall and the flooring the situation involving an additional panel 'Q' for "raked" ceilings.

Roof panels H and D connect in the standard manner and panel Q connects to these as per FIG. 5*a*.

Wall panels Q and P connect to each other as per FIG. 4*b* replacing the coach screw style securing devices with permanent secured nut and bolt style securing devices through an 'I' beam or similar.

Floor panels R and L attach in the standard manner and interior wall panel P attaches to these as per FIG. 5*a* with (34) being replaced by a suitable length coach bolt or similar (41) and this being attached into the top of the stump below.

Referring now to FIG. 5(*d*)

This relates to a special panel 'Z' designed to locate as the last panel in a wall where accessibility for a standard panel is a problem. This type of panel will be used whenever a 'closed' section has a panel space that needs to be enclosed.

This panel can be reduced size panel as per FIG. 8 (60) or standard as required. The traditional ⊔ channel joiner sections, both connecting to the adjoining wall as in 5(*a*), and the vertical female joining section of the panel, are in this instance replaced with 'L' shaped sections, (69) attached vertically to the inside of the external wall, (in this example), & (70) replaces one female edge of the panel frame. These facilitate sliding the panel laterally into position between two fixed panels. The panel is secured in the usual way.

The gaps (71 & 72) left at either end of this panel are filled with a strip of wall cladding material to suit and secured in the usual way.

Referring now to FIG. 6

FIG. 6 shows a cross-section of roof panel H and wall panel F.

Wall panel F and subsequent wall panels are joined at the top by plate (15) (FIG. 2). This is located within the ⊔ channel section of panel F by the standard securing devices running through correctly aligned holes in (15).

Threaded securing device (16) (FIG. 2) locates into the fastening holes on all panels as per FIG. 3 and into the permanent nut (17) on underside of (15). The choice of fastening hole used depends on the width of eave overhand selected.

Panel H (roof) has a suitable internal lining (42) up to the external wall than a suitable external lining (43) under the eaves and a layer of reflective foil (44) on the upper surface.

Wooden (or similar) battens (45) are attached to the upper surface if the roof and cladding (46) and condensation needs require it. The cladding is then attached in the appropriate manner. A square section or similar, gutter and fascia board (47) is then attached to a panel end stop and barge board, (or similar if required (48)), in the standard panel connecting manner.

The ridge bean (49) can be of any suitable material and sized accordingly. Attached to this are especially made (bent or extruded) ridge joiners (50). Standard securing devices through the beam hold them firm and the roof panel H attaches to them using standard securing in the usual way.

If a raked ceiling is required a small plaster infill (51) can fill the gap between F and H. If a flat ceiling is required a proprietary suspended ceiling (52) can be hung by using the heads of the securing devices to hold the hanging rods (53).

FIG. 6C shows a strengthening insert (54) which can be inserted into any standard joint for extra strengthening ie. heavy load bearing floors, two storey walls, long span rooves. This should be made of the same substance as the panel frames and can be of either square channel or 'L' section is required.

FIG. 6(*d*) shows the strengthening insert section being located into place before fastening down the roof panels. Note: The extra panels (55) to lengthen the roof to the required span. Also note the typical gable end of a structure using the end fill panels (56) (panel 'J', FIG. 3). Panels 55 and 56 may well be of non modular proportions, but connect in the standard manner.

FIG. 6(*a*) shows a cross sectional view of the end of the ridge beam as per FIG. 6(*b*).

Panels 'H' and '$H_1$' are attached as per FIG. 6(*b*) and are set to the rear edge of the end panels '$J_1$' and '$J_2$' as per FIG. 3 as indicated by the broken lines.

The ends of the ridge beam are located onto the top edges of the end panels $J_1$ and $J_2$ (ie. (56) ). At this point an 'L' shaped rigid bracket of suitable material (65) and (66) welded into place supports the lower edge of the ridge beam.

$J_1$ and $J_2$ are located and connected in place; the two 'L' brackets 65 and 66 forming a ⊔ shape. The ridge beam is then lowered into place in the Channel shape and secured by through bolt (68). This occurs at each ridge and wall junction throughout the structure.

Referring now to FIG. 7

Figure 7A:
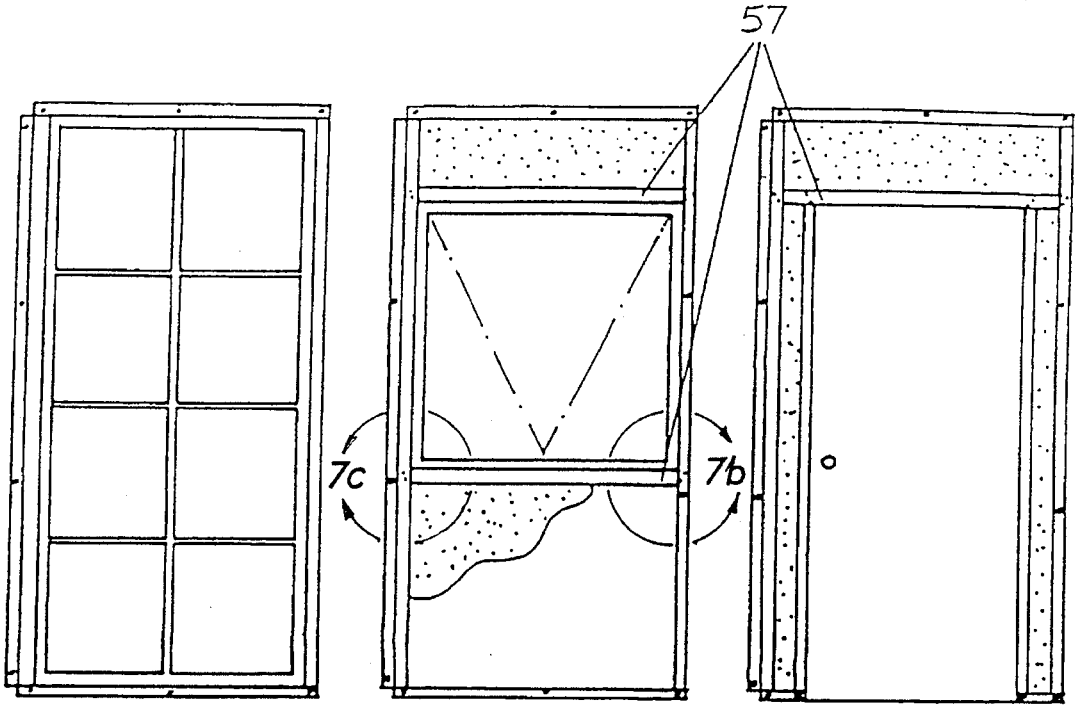

This FIG. 7*a* shows three of the possible options for fittings within the panel module.

The fittings are standard proprietary articles in any material. The remaining unfilled areas of the panel are filled with the standard rigid insulation.

Figure 7B:
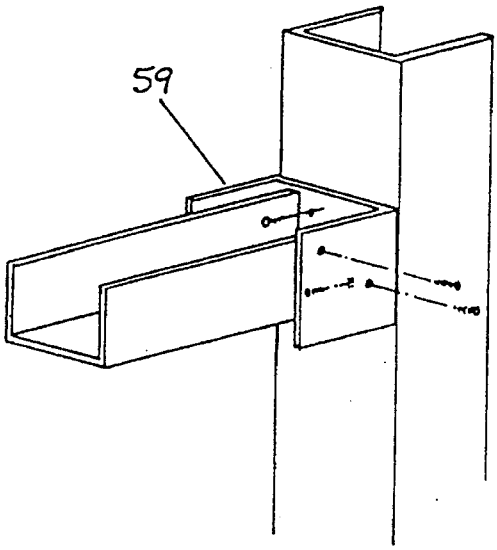

The supporting cross members (57) are attached to the panel frame by any suitable fixing method (tek screws (58), welding etc.) as seen in FIGS. 7*a* and 7*b*, (representing opposite sides of the standard panel frame).

In FIG. 7*b* the cross member (57) fits into a locating piece of ⊔ channel (59) which itself is fixed to the panel side as in (58).

Figure 7C:
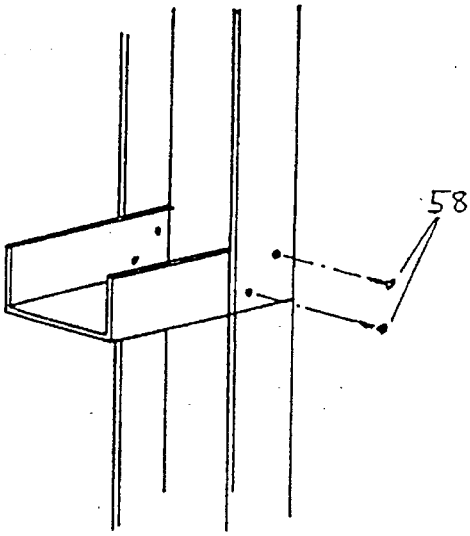

The cross member (5? ) is then fixed in the same way. In FIG. 7C the cross member slots inside the panel frame and is attached as above. Note: This is one of a number of optional methods of attachement. Also note; The electrical and plumbing services run through the gaps created by the top and bottom plates respectively. These have not been drawn as their location is not central to the invention.

Referring now to FIG. 8

Figure 8A:
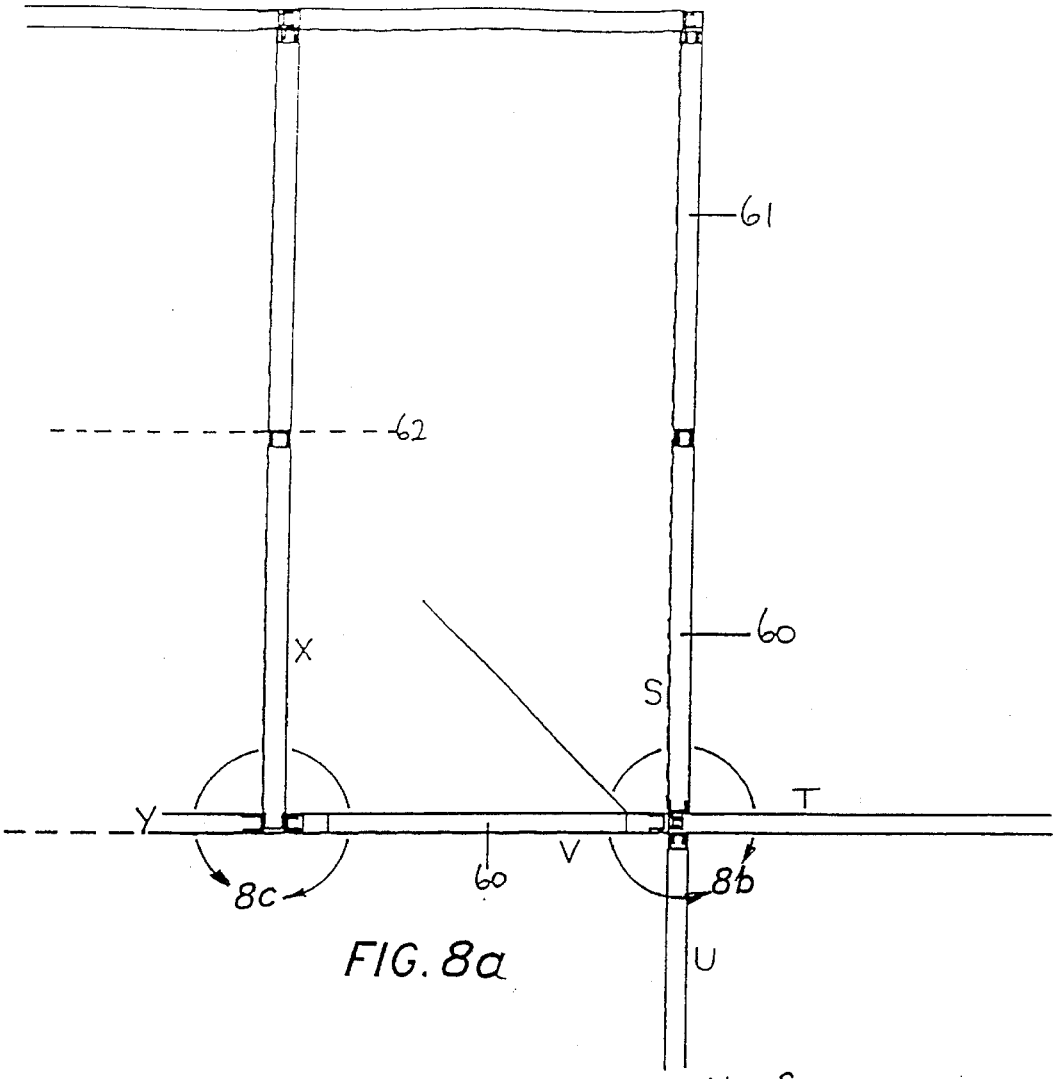

FIG. 8*a* shows a plan view of the layout of panels in an internal corner situation. This creates the need for two slightly narrower (reduced) panels (60).

Note the dotted line around the edges of the panels S and V. This indicates the floor panel and the wall locations in relation to this.

The dotted line (62) indicates a possible panel location either for floor or roof.

Figure 8C:
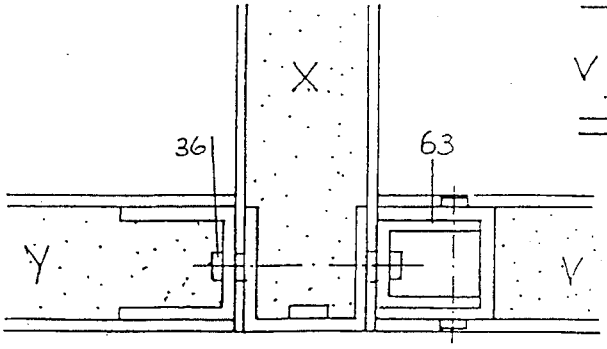
Figure 8B:
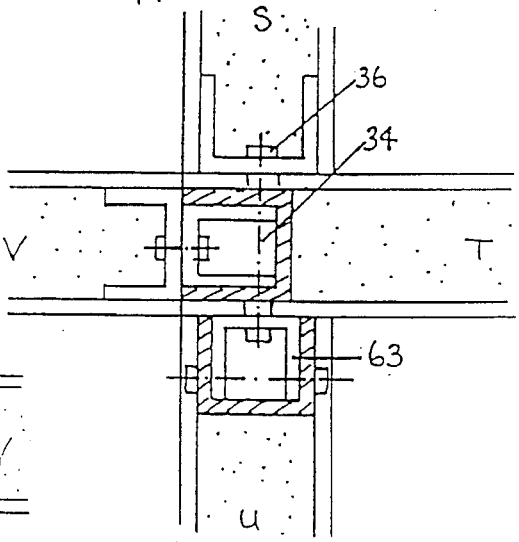

FIG. 8*b* shows an inset of the four cornered junction. The male ⊔ channel joiner (63) is removed from the fixing end of the panel S.

Panels T and V are located in the usual way but not yet secured. An extended securing device (34) (FIG. 5.) then aligns and secures the male jointer (63) to the opposite side of panel T and the end of panel S. Panel U then attaches to (63) in the usual way.

In a three cornered situation such as FIG. 8*c* the male joiner (ie.(63)) is removed from panel X (as in panel S in the previous example) and the two panels V and Y connect together through the sides of the frame of panel X in the usual way.

Panel V may need to be substituted for panel X (FIG. 5(*d*)) given the 'closed' module in this situation.

Referring now to FIG. 9

Figure 9A:
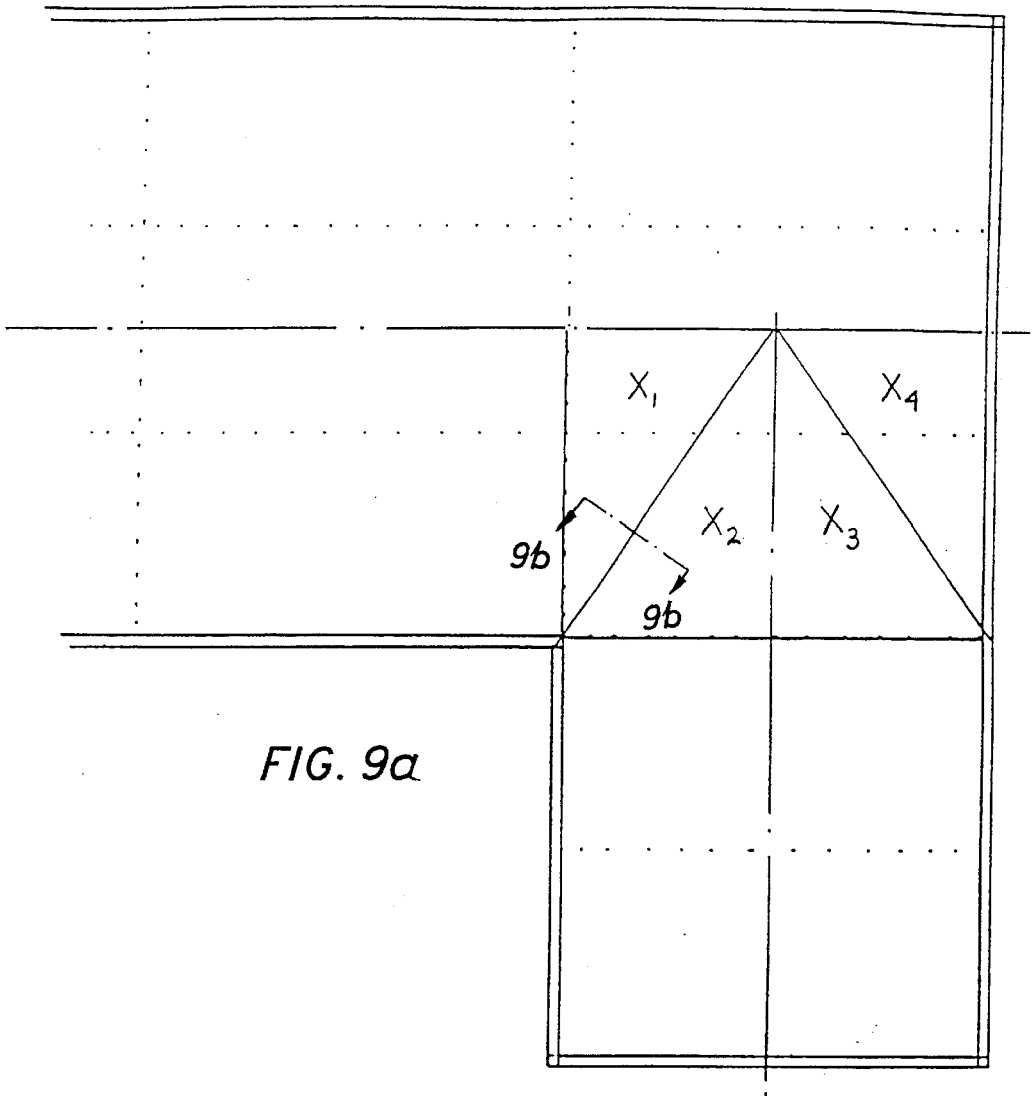

FIG. 9*a* shows the hip and valley situation in an 'L' shaped structure ie. uses two ridges.

This creates the need for four triangular panels the dimensions of which change depending on the number of modules used, the pitch of the roof required, and the width of the eaves. The example in FIG. 9 shows no eaves used.

Each of the panels 'x' will be the same size, and will locate into the ridge and the roof panels in the same plane, in the usual way (FIG. 6 and 5*c* respectively).

Figure 9B:
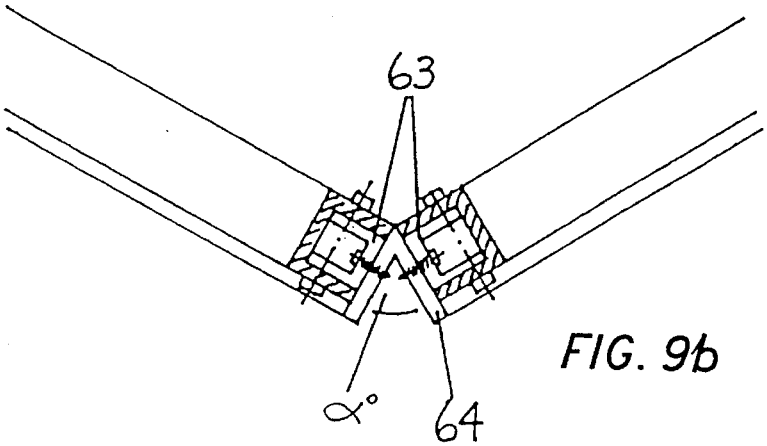

The location and securing in the bottom of the valley is described in FIG. 9*b*. Two male ⊔ channel connecting piece (63) (FIG. 8) are attached to either side of the joiner section (64).

This section (64) is constructed of the same material as the frame and could be moulded, extruded or bent to achieve the correct angle (∝ °) to suit the particular valley's requirements. Note: dotted lines indicate the floor panels below and the broken lines indicate the ridge locations.

The detailed description herein provides for the first time a full description of a truly universal building unit capable of a multitude of versatile application in the building industry. As detailed in the description of the prior art, the long felt want for such a system, allowing minimal componentry without compromising flexibility has not until now, been fulfilled. The elegant simplicity of the instant invention provides the basis for the successful results which are supported by detailed strength and engineering tests which clearly support performance results beyond required standards for uniaxial loading of wall panels constructed of double skin 6 mm cement sheet with 75 mm polystyrene core. Floor panels constructed of a single skin 20 mm particle board with 75 mm foam core similarly exceeded required standards.

What is claimed is:

1. A modular construction panel system comprising:

a plurality of panels each formed by a rectangular frame, said frame including a rectangular border defined by four channel elements, said channel elements having substantially similar U-shaped cross-sections, a first pair of said channel elements forming left and right vertical panel edges and a second pair of said channel elements forming horizontal top and bottom panel edges, one of said first pair of channel elements oriented with a hollow portion facing outward, while a second of said first pair of channel elements oriented with a hollow portion facing inward so that a planar face of said second channel element defines said border along one vertical panel edge;

bracing in the form of skin or cladding attached to at least two of said channel elements, said bracing defining sides of a panel parallel to a plane defined by said rectangular frame; and a tongue element having a flat face and being demountably attachable to said panel in either of two configurations, said tongue element forming an edge joiner when said flat face attaches to the planar face of said second channel element, and said tongue forming a corner joiner when said flat face attaches to the bracing adjacent said border, said edge joiner and said corner joiner for connecting adjacent edges of two panels disposed in a single plane and in two perpendicular planes, respectively.

2. A modular construction panel system according to claim 1 wherein said rectangular frame has a length dimension being a whole multiple of the width dimension.

3. A modular construction panel system according to claim 1 wherein the bracing is in the form of a skin or cladding attached to the whole of one or both sides of said frame.

4. A modular construction panel system according to claim 1 wherein said tongue has a U-shaped cross-section and provides a hollow interior therein defining a duct through which services can pass.

5. A modular construction panel system according to claim 1 wherein said tongue element is removably attached to said channel element or said bracing by bolting into captured nuts.

6. A modular construction panel system according to claim 1 wherein said frame is constructed of metal with the channel elements thereof welded together into an integral rigid unit.

7. A modular construction panel system according to claim 6 wherein the frame is constructed of steel.

8. A modular construction panel system according to claim 2 where the dimensions of said frame provide a ratio of 2:1 of the length dimension to width dimension.

9. A modular construction panel system according to claim 2 where the dimensions of said frame provide a ratio of 3:1 of the length dimension to width dimension.

10. A modular construction panel system according to claim 1 where the rectangular frame is filled with an insulating material.

11. A modular construction panel system according to claim 1, wherein at least one side of the frame is covered by said bracing which extends to the edges of the panel substantially flush with the outer border.

12. A building system comprising:

a plurality of modular rectangular panels having four side edges and opposed faces, wherein at least some of said panels comprise a rectangular supporting frame;

said frame including four channel elements extending along four side edges of the panel, each channel element having a planar base and opposed side walls defining a groove, three of the channel elements being oriented with the channel groove facing outwardly and along a fourth side edge of the panel the channel element is oriented with the groove facing inwardly and the planar base of the channel element extending along and flush with the fourth side edge;

a tongue element having a flat face; and releasable attachment means for securing the flat face of the tongue element to the planar base of said channel element extending along the fourth side edge such that the tongue element projects outwardly from the fourth side edge, said tongue element sized to fit closely between said side walls and having a dimension parallel to and shorter than the depth of the groove, wherein a tongue and groove connection is provided between two of said panels with said tongue element of a first panel extending into and covered by a groove of a second panel, and wherein said releasable attachment means permits removal of said tongue element from the channel element along said fourth side edge.

13. A building system according to claim 12, wherein the tongue element is of U-shaped channel section having a base and opposed side walls, and the releasable attachment means comprise screw means extending through the base of the tongue element and into the adjacent channel element of the frame of the panel, the interior of the channel section tongue element defining a duct through which services can pass.

14. A building system according to claim 12, wherein at least some of said panels are wall panels wherein the side edges provide opposed vertical side edges and upper and lower side edges, and the fourth side edge is one of said vertical side edges of the wall panel, and said system further comprises elongate connecting elements receivable within the grooves along the upper and lower side edges for attachment of the panel to roof structure and floor structure, respectively.

15. A building system according to claim 14, wherein the elongate connecting elements are of channel section.

16. A building system comprising:

a plurality of modular rectangular panels having four side edges and opposed faces, wherein at least some of said panels comprise a rectangular supporting frame;

said frame including four channel elements extending along four side edges of the panel, each channel element having a planar base and opposed side walls defining a groove, three of the channel elements being oriented with the channel groove facing outwardly and along a fourth side edge of the panel the channel element is oriented with the groove facing inwardly and the planar base of the channel element extending along and flush with the fourth side edge;

a tongue element having a flat face; and releasable attachment means for securing the flat face of said tongue element flush to one of said opposed faces of said first said panel adjacent a side edge thereof with the attachment means extending into the side wall of the channel element at that side edge, said tongue element sized to fit closely between said side walls and having a dimension parallel to and shorter than the depth of the groove, said tongue element thereby enabling a corner connection with the tongue element of a first panel engaging within one of said grooves of a second panel, said tongue element being completely covered by said groove, and wherein said releasable attachment means permits removal of said tongue element from said face.

17. A building system according to claim 16, wherein the tongue element is of U-shaped channel section having a base and opposed side walls, and the releasable attachment means comprise screw means extending through the base of the tongue element and into the side wall of the channel element along the side edge of the panel, the interior of the channel section tongue element defining a duct through which services can pass.

18. A building system according to claim 16, wherein at least some of said panels are wall panels wherein said system further comprises elongate connecting elements receivable within the grooves along the upper and lower side edges for attachment of the panel to roof structure and floor structure, respectively.

19. A building system according to claim 18, wherein the elongate connecting elements are of channel section.

20. A building system comprising:

a plurality of modular rectangular panels having side edges and opposed faces, wherein at least some of said panels comprise a structural frame, said frame providing along at least one side edge of each panel a channel extending along that side edge, said channel having a base and opposed side walls;

a separate tongue arranged to extend along and project from a side edge opposite to said one side edge; and releasable attachment means for attaching the tongue to the frame along said opposite side edge of a first panel, said tongue being engageable within a channel of a second panel when the two panels are arranged with their adjacent side edges in abutting relation, said attachment means being releasable permitting removal of the tongue from the first panel, said tongue being reattachable to a face of said first panel forming a corner connection between the first panel and said second panel with the tongue engaging the channel along the side edge of the second panel, reattachment of the tongue to provide the corner connection being effected by attachment means extending through the side wall of the channel of the first panel.

21. A building system according to claim 20, wherein the tongue fits closely within the side walls of the channel of the adjacent panel.

22. A building system according to claim 20, wherein the tongue consists of a channel element having a base and opposed side walls, said tongue being attached to the frame of the panel by passage of the attachment means through the base of the channel element forming the tongue.

* * * * *